US012473123B2

(12) United States Patent
Filippini et al.

(10) Patent No.: US 12,473,123 B2
(45) Date of Patent: Nov. 18, 2025

(54) LID-SPOUT ASSEMBLY FOR A PACKAGE AND PACKAGE HAVING A LID-SPOUT ASSEMBLY

(71) Applicant: Tetra Laval Holdings & Finance S.A., Pully (CH)

(72) Inventors: Maurizio Filippini, Modena (IT); Francesca Tavoni, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 171 days.

(21) Appl. No.: 18/247,169

(22) PCT Filed: Nov. 12, 2021

(86) PCT No.: PCT/EP2021/081474
§ 371 (c)(1),
(2) Date: Mar. 29, 2023

(87) PCT Pub. No.: WO2022/101385
PCT Pub. Date: May 19, 2022

(65) Prior Publication Data

US 2023/0406578 A1 Dec. 21, 2023

(30) Foreign Application Priority Data

Nov. 16, 2020 (EP) ..... 20207705

(51) Int. Cl.
*B65D 41/46* (2006.01)
*B65D 41/50* (2006.01)
(Continued)

(52) U.S. Cl.
CPC ..... *B65D 41/46* (2013.01); *B65D 41/50* (2013.01); *B65D 47/06* (2013.01); *B65D 55/16* (2013.01);
(Continued)

(58) Field of Classification Search
None
See application file for complete search history.

(56) References Cited

U.S. PATENT DOCUMENTS 11,987,426 B2 * 5/2024 Filippini ..... B65D 47/141
2023/0182953 A1 * 6/2023 Palladino ..... B29C 45/14 220/268
(Continued)

FOREIGN PATENT DOCUMENTS

CN 1675108 A 9/2005
CN 111516986 A 8/2020
(Continued)

OTHER PUBLICATIONS

International Search Report mailed Mar. 14, 2022, for priority International Application No. PCT/EP2021/081474.

*Primary Examiner* — Paul R Durand
*Assistant Examiner* — Michael J. Melaragno
(74) *Attorney, Agent, or Firm* — Renner, Otto, Boisselle & Sklar, LLP

(57) ABSTRACT

A lid-spout assembly for a package having a main body comprising a designated pour opening and being filled with a pourable product. The lid-spout assembly comprises at least a spout having a pouring outlet, a lid configured to selectively close and open the pouring outlet and a tethering element tethering the lid to the spout and/or the main body. The spout comprises a base frame coupling and/or configured to couple the spout to the main body about the designated pour opening and a collar carrying and/or comprising the pouring outlet and being fixed to and protruding from the base frame. The lid is moveable at least in a closed position in which the lid closes and/or seals the pouring outlet and an open position in which the lid opens the pouring outlet. The lid comprises an interaction ridge being configured to interact with the collar so as to determine a
(Continued)

closing force with the lid being arranged in the closed position for retaining the lid in the closed position.

13 Claims, 5 Drawing Sheets

(51) Int. Cl.
*B65D 47/06* (2006.01)
*B65D 55/16* (2006.01)
*B65D 65/40* (2006.01)

(52) U.S. Cl.
CPC ..... *B65D 65/40* (2013.01); *B65D 2251/1041* (2013.01)

(56) References Cited

U.S. PATENT DOCUMENTS

| | | | | |
|---|---|---|---|---|
| 2023/0182971 | A1* | 6/2023 | Filippini | B65D 47/141 222/556 |
| 2023/0182972 | A1* | 6/2023 | Filippini | B65D 43/0272 220/268 |
| 2023/0356888 | A1* | 11/2023 | Zanon | B65D 41/32 |
| 2023/0406578 | A1* | 12/2023 | Filippini | B65D 41/46 |

FOREIGN PATENT DOCUMENTS

| | | | |
|---|---|---|---|
| CN | 111746930 | A | 10/2020 |
| DE | 202005005442 | U1 | 10/2005 |
| EP | 3590856 | A1 | 1/2020 |
| JP | H07291276 | A | 11/1995 |
| JP | 2008074428 | A | 4/2008 |
| KR | 20030023685 | A | 3/2003 |

* cited by examiner

LID-SPOUT ASSEMBLY FOR A PACKAGE AND PACKAGE HAVING A LID-SPOUT ASSEMBLY

TECHNICAL FIELD

The present invention relates to a lid-spout assembly for a package, in particular a package having a sealed main body, filled with a pourable product, even more particular filled with a pourable food product.

Advantageously, the present invention also relates to a package, in particular a package having a sealed main body, filled with a pourable product, even more particular filled with a pourable food product, and comprising a lid-spout assembly.

BACKGROUND ART

As is known, many pourable food products, such as fruit juice, UHT (ultra-high-temperature treated) milk, wine, tomato sauce, etc., are sold in packages, in particular sealed packages, made of sterilized packaging material.

A typical example is the parallelepiped-shaped package for pourable food products known as Tetra Brik Aseptic (registered trademark), which is made by sealing and folding a laminated strip packaging material. The packaging material has a multilayer structure comprising a carton and/or paper base layer, covered on both sides with layers of heat-seal plastic material, e.g. polyethylene. In the case of aseptic packages for long-storage products, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Some known packages comprise each a sealed main body having a designated pour opening and a lid-spout assembly arranged on the main body about the designated pour opening and configured to allow for a controlled outpouring of the pourable product.

Each lid-spout assembly comprises a spout having a pouring outlet and a lid removably coupled to the spout so as to selectively close and open the pouring outlet.

In order to avoid any unwanted littering of the lid, the lid-spout assembly may also comprises a tethering element connecting the lid and the spout with one another.

During the first-time use, the lid is brought to an open position.

After the first-time use it may be possible to arrange the lid in a closed position so as to cover the pouring outlet.

An inconvenience is that it may occur that the lid may move from the closed position to the open position in an uncontrolled manner.

Therefore, a desire is felt in the sector to further improve such lid-spout assemblies.

DISCLOSURE OF INVENTION

It is therefore an object of the present invention to provide in a straightforward and low-cost manner an improved lid-spout assembly for a package, in particular a package having a sealed main body, filled with a pourable product, even more particular filled with a pourable food product.

In particular, it is an object of the present invention to provide in a straightforward and low-cost manner an improved lid-spout assembly for a package, in particular a packaging having a sealed main body, filled with a pourable product, even more particular filled with a pourable food product, which ensures that the lid does not unintentionally move from the closed position to the open position.

It is a further object of the present invention to provide in a straightforward and low-cost manner a package, in particular a package having a sealed main body, filled with a pourable product, in particular filled with a pourable food product, having an improved lid-spout assembly, in particular the lid-spout assembly ensuring that the lid does not unintentionally move from the closed position to the open position.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Number 1 indicates as a whole a package comprising:

- a (sealed) main body 2, in particular a sealed composite body, being filled with a pourable product, in particular a pourable food product, and having a designated pour opening (not shown and known as such) configured to allow for an outflow of the pourable product from main body 2; and
- a lid-spout assembly 3 coupled to main body 2 arranged and/or arrangeable about the designated pour opening and configured to allow for a controlled outpouring of the pourable product from main body 2.

According to some preferred non-limiting embodiments, main body 2 is obtained from a packaging material, in particular a composite packaging material, having a multilayer structure (not shown and known as such).

Preferentially, the packaging material is provided in the form of a web.

Preferentially, main body 2 is obtained by forming a tube from the packaging material, longitudinally sealing the tube, filling the tube with the pourable product and by transversally sealing and cutting the tube.

Preferentially, the packaging material comprises at least one layer of fibrous material, such as e.g. paper or cardboard, and at least two layers of heat-seal plastic material, e.g.

polyethylene, interposing the layer of fibrous material in between one another. One of these two layers of heat-seal plastic material defines the inner face of main body 2 contacting the pourable product.

Preferably, the packaging material also comprises a layer of gas- and light-barrier material, e.g. aluminum foil or ethylene vinyl alcohol (EVOH) film, in particular being arranged between one of the layers of the heat-seal plastic material and the layer of fibrous material. Preferentially, the packaging material also comprises a further layer of heat-seal plastic material being interposed between the layer of gas- and light-barrier material and the layer of fibrous material.

According to some non-limiting embodiments, lid-spout assembly(ies) 3 is/are applied to the packaging material prior to arranging the packaging material within or during advancement of the packaging material through a packaging machine for forming, filling and sealing main bodies 2 from the packaging material carrying lid-spout assembly(ies) 3.

In particular, application of lid-spout assembly (ies) 3 to the packaging material occurs by means of a molding process and/or adhesive bonding and/or ultrasonic bonding.

Figure 1:
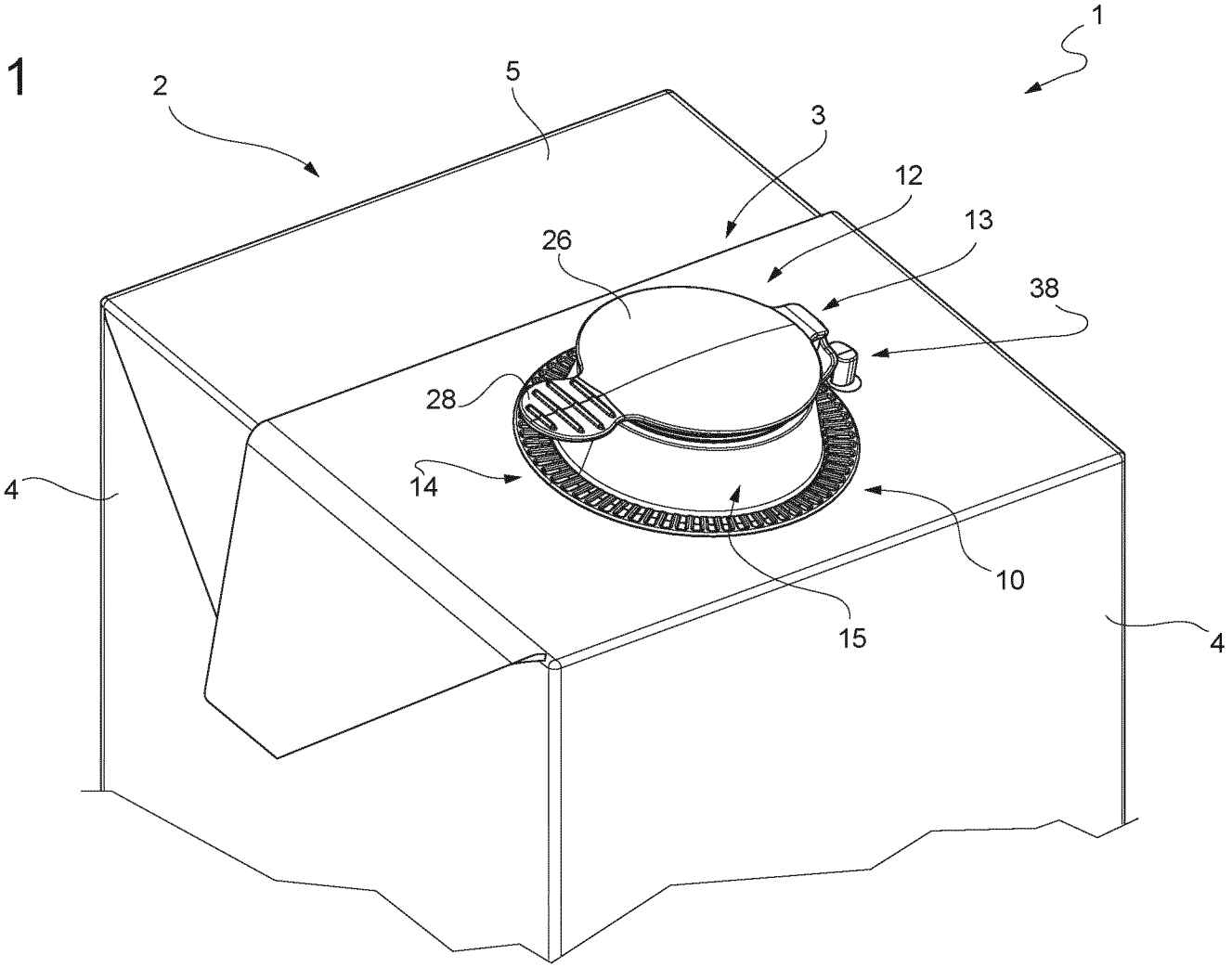
FIG. 1 is a schematic perspective view of a package having a lid-spout assembly according to the present invention being in a first configuration, with parts removed for clarity.
Figure 2:
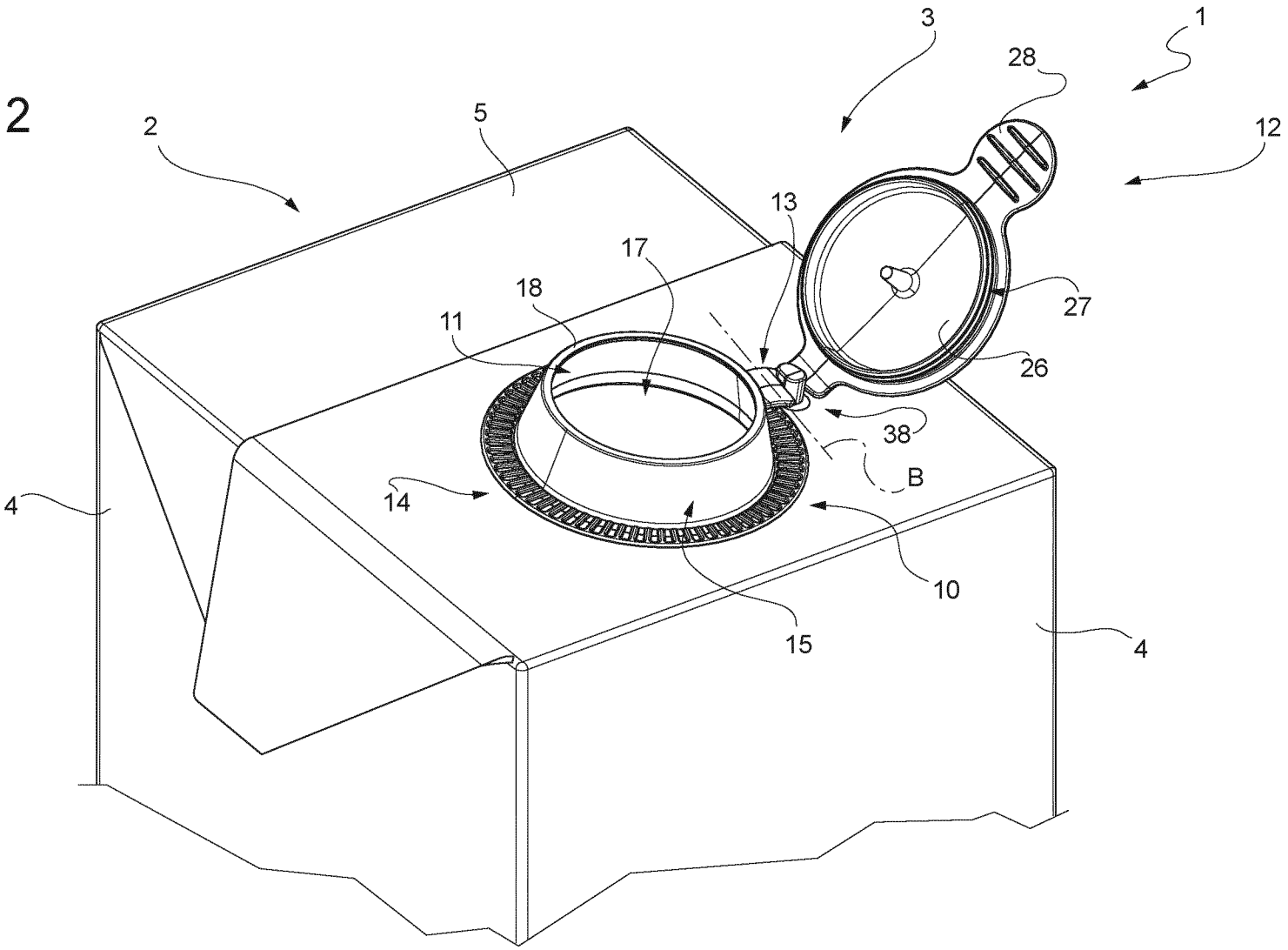
FIG. 2 is a schematic perspective view of the package of FIG. 1 with the lid-spout assembly being in a second configuration, with parts removed for clarity.

With particular reference to FIGS. 1 and 2, main body 2 extends along a longitudinal axis, a first transversal axis and a second transversal axis. In particular, the extension of package 2 along the longitudinal axis is larger than the extension of package 2 along the first transversal axis and the second transversal axis.

Preferentially, main body 2 is parallelepiped-shaped.

In more detail, main body 2 may comprise a first wall portion, in particular being transversal, even more particular perpendicular, to the longitudinal axis, from which main body 2 extends along the longitudinal axis. Preferentially, the first wall portion defines a support surface of package 1, in particular of main body 2, which is designed to be put in contact with a support, such as e.g. a shelf, when, in use, being e.g. exposed within a sales point or when being stored. In particular, when being arranged on a support the first wall portion defines a bottom wall portion of main body 2 and/or package 1.

In further detail, main body 2 may also comprise a plurality of lateral walls 4 being (fixedly) connected to the first wall portion and extending, in particular substantially parallel to the longitudinal axis, from the first wall portion.

In even further detail, main body 2 may also comprise a second wall portion 5 opposite to the first wall portion and being (fixedly) connected to at least some of lateral walls 4. In particular, lateral walls 4 are interposed between the first wall portion and second wall portion 5. In particular, when main body 2 is arranged on a support second wall portion 5 defines a top wall portion.

According to the non-limiting embodiment shown, the first wall portion and second wall portion 5 are inclined with respect to one another. In particular, while the first wall portion has a horizontal orientation when being placed on the support, second wall portion 5 is inclined with respect to the first wall portion and the support.

Alternatively, the first wall portion and second wall portion 5 may be parallel to one another.

According to some preferred non-limiting embodiments, second wall portion 5 carries and/or comprises the designated pour opening and lid-spout assembly 3 is mounted to second wall portion 5.

Furthermore, package 1, in particular main body 2, comprises an inner space configured to contain and/or containing the pourable product.

With particular reference to FIGS. 1 to 6*b*, lid-spout assembly 3 comprises at least:

- a spout 10 being connected or being connectable to main body 2 about the designated pouring outlet and having a pouring outlet 11 configured to allow for a (controlled) outflow of the pourable product from spout 10 itself (and main body 2 and/or package 1 and/or the inner space);
- a lid 12 configured to selectively close and open pouring outlet 11; and
- a tethering element 13 (permanently) tethering and/or coupling lid 12 to spout 10 and/or main body 2.

According to some preferred non-limiting embodiments, lid-spout assembly 3, in particular spout 10, lid 12 and tethering element 13, is/are formed and/or molded, in particular simultaneously molded, from a polymer and preferentially in a single piece. In particular, lid-spout assembly 3 is directly molded on the package material about the designated pouring outlet, even more particular prior to the folding of the packaging material.

In more detail, spout 10 may comprise at least:

- a base frame 14 coupling and/or configured to couple spout 10 to main body 2, in particular to second wall portion 5, about the designated pour opening; and
- a collar 15 carrying and/or comprising pouring outlet 11 and being fixed to and protruding from base frame 14.

In even more detail, collar 15 may extend along a central axis A and carries and/or comprises pouring outlet 11 at a first axial end of collar 15. Furthermore, collar 15 may also comprise an inlet opening 16 for the pourable product positioned at a second axial end of collar 15 opposite to the first axial end.

Preferentially, collar 15 delimits and/or comprises a flow channel 17 for the pourable product, in particular extending between inlet opening 16 and pouring outlet 11. In use, collar 15 is configured such to receive the pourable product from the inner space through inlet opening 16 and such that the pourable product flows out of pouring outlet 11.

According to some preferred non-limiting embodiments, collar 15 comprises a rim 18 delimiting pouring outlet 11, and in particular a rim 19 opposite to rim 18 delimiting inlet opening 16. In particular, rim 18 is arranged at the first axial end of collar 15 and preferentially rim 19 is arranged at the second axial end of collar 15.

Preferentially, rim 18 radially protrudes inwards and/or towards central axis A. In other words, rim 18 restricts the cross-section of pouring outlet 11.

Moreover, rim 18, even more also rim 19, may have a respective circular shape. Alternatively, rim 18 and/or the rim 19 could have a square and/or a rectangular and/or an elliptical and/or an oval shape.

According to some preferred non-limiting embodiments, collar 15, in particular rim 18, is designed such to allow a consumer to drink from spout 10, in particular collar 15.

Moreover, collar 15 may have a tubular configuration.

Preferentially, collar 15 has an annular cross-sectional profile with respect to a cross-sectional plane perpendicular to central axis A. In particular, the cross-sectional profile has a circular shape. Alternatively, the cross-sectional profile could have an oval or square or elliptical or rectangular shape.

Preferentially, collar 15 is shaped such to facilitate the outflow of the pourable product from collar 15 itself.

Figure 3:
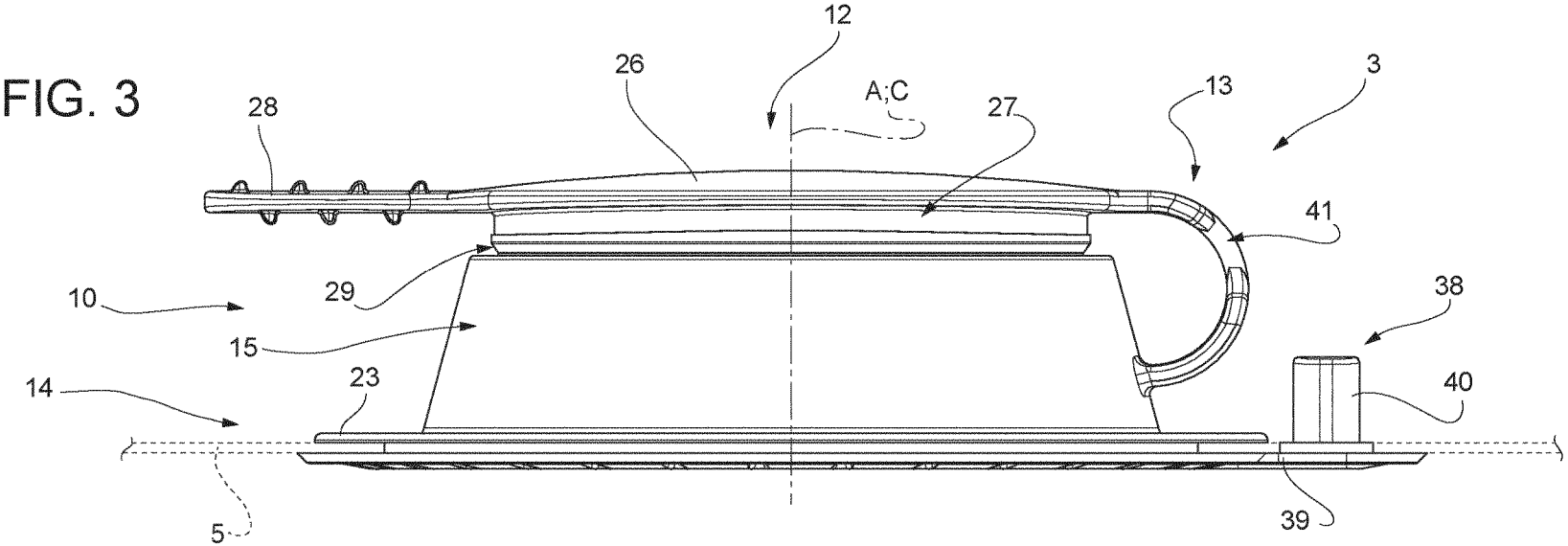
FIG. 3 is an enlarged side view of the lid-spout assembly of FIG. 1 being in the first configuration, with parts removed for clarity.
Figure 4:
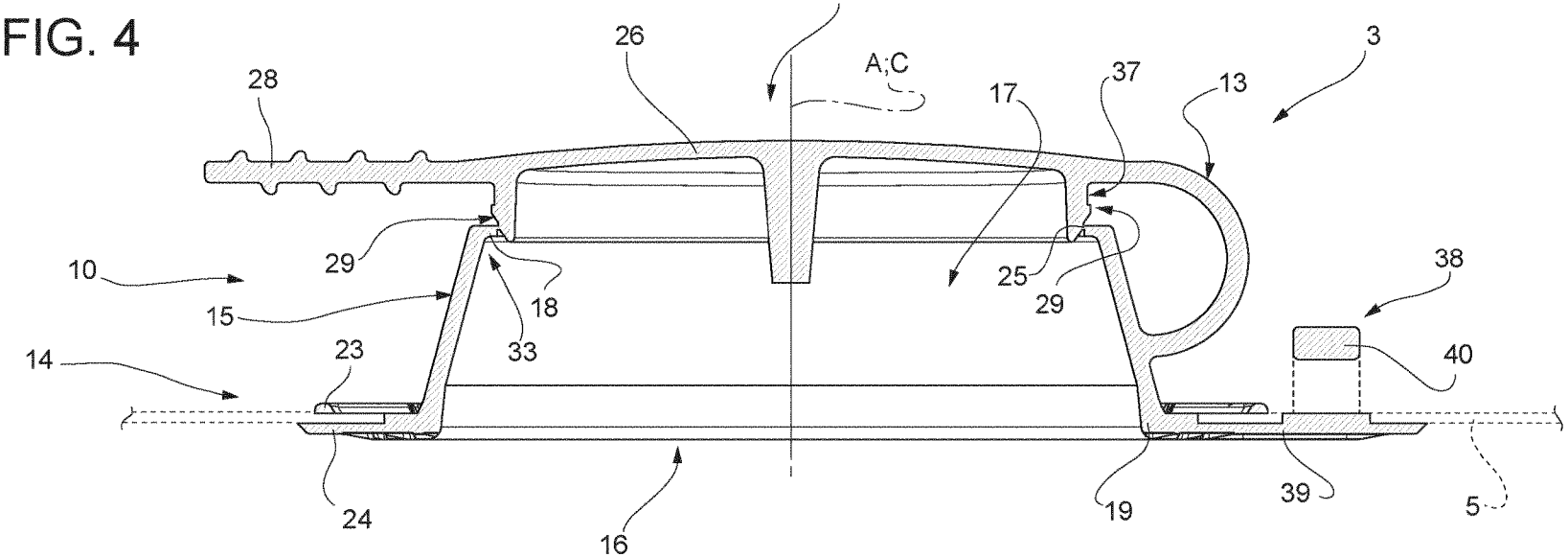
FIG. 4 is an enlarged lateral section view of the lid-spout assembly being in the first configuration, with parts removed for clarity.
Figure 5:
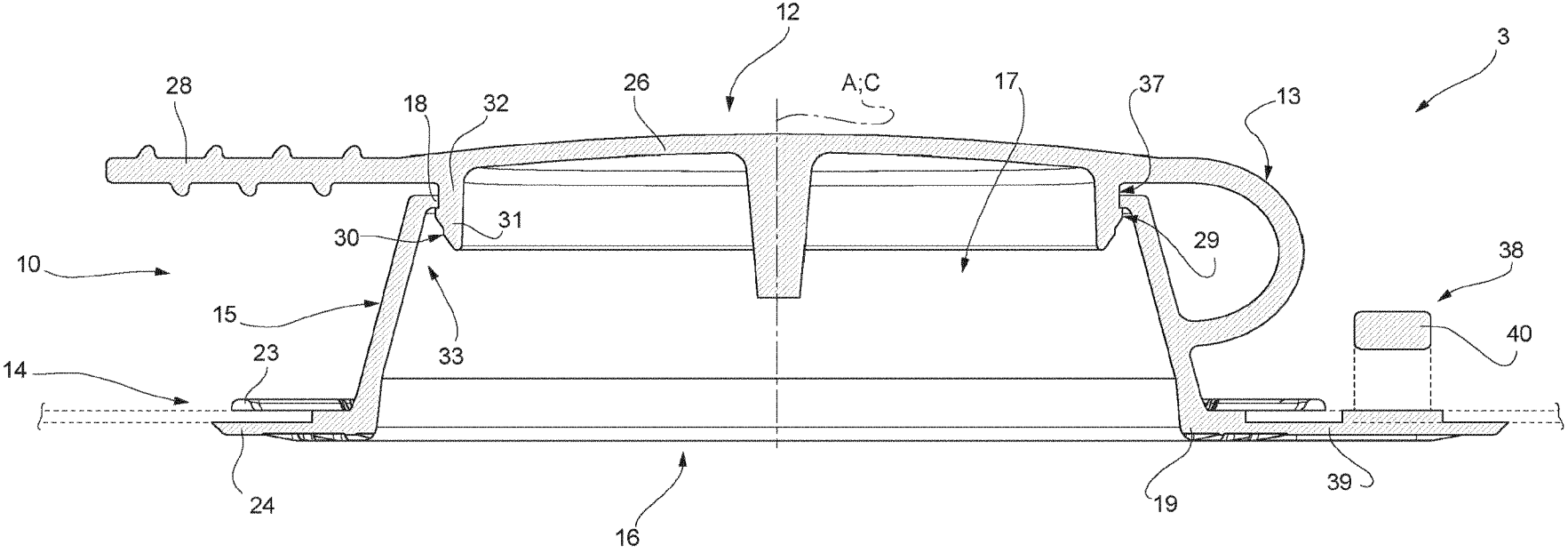
FIG. 5 is an enlarged lateral section view of the lid-spout assembly being in a third configuration, with parts removed for clarity.

With particular reference to FIGS. 3, 4 and 5, base frame 14 comprises a first annular portion 23 and a second annular portion 24 axially displaced from one another with respect to central axis A and configured to interpose and/or interposing a portion of main body 2, in particular second wall portion 5, between one another. In particular, the portion of main body 2, in particular of second wall portion 5, is at the designated pour outlet.

According to some preferred non-limiting embodiments, lid 12 is controllable between at least:

- a closed position (see FIGS. 5 and 6*b*) in which lid 12 is configured to close and/or seal pouring outlet 11, in particular for impeding an outflow of the pourable product out of pouring outlet 11; and
- an open position (see FIG. 2) in which lid 12 is configured to open and/or free pouring outlet 11 (lid 11 is configured to be and/or is detached from pouring outlet 11), in particular for allowing an outflow of the pourable product through pouring outlet 11.

In more detail, lid 12 may be angularly moveable around a hinge axis B and lid 12 may be in a first angular position and in a second angular position with respect to hinge axis B when being controlled in respectively the closed position and the open position.

Figure 6A:
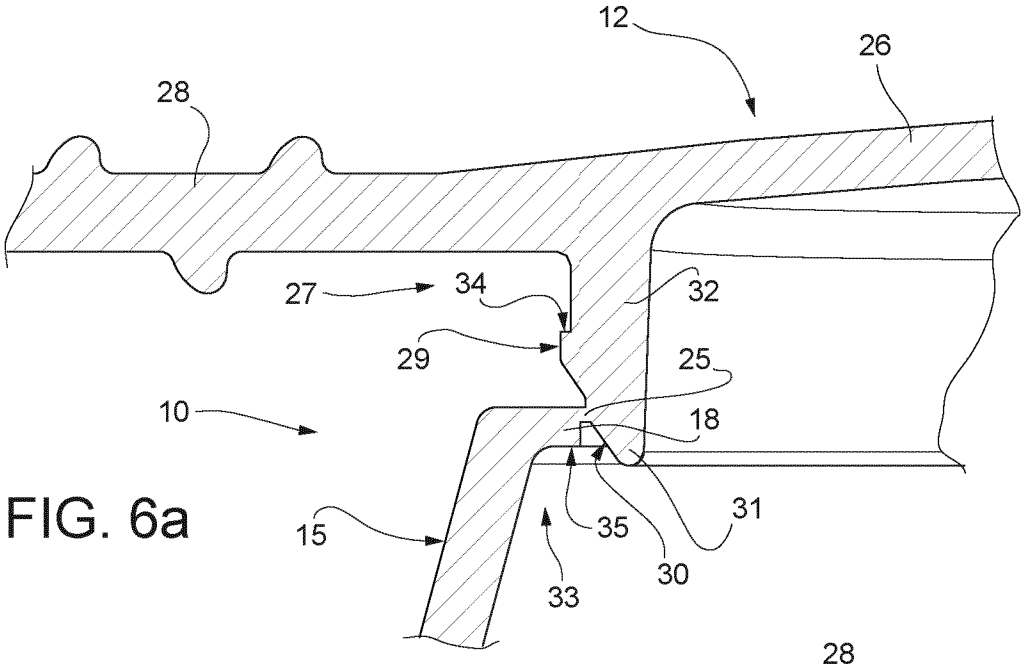
FIG. 6*a* is an enlarged section view of a detail of the lid-spout assembly being in the first configuration, with parts removed for clarity.
Figure 6B:
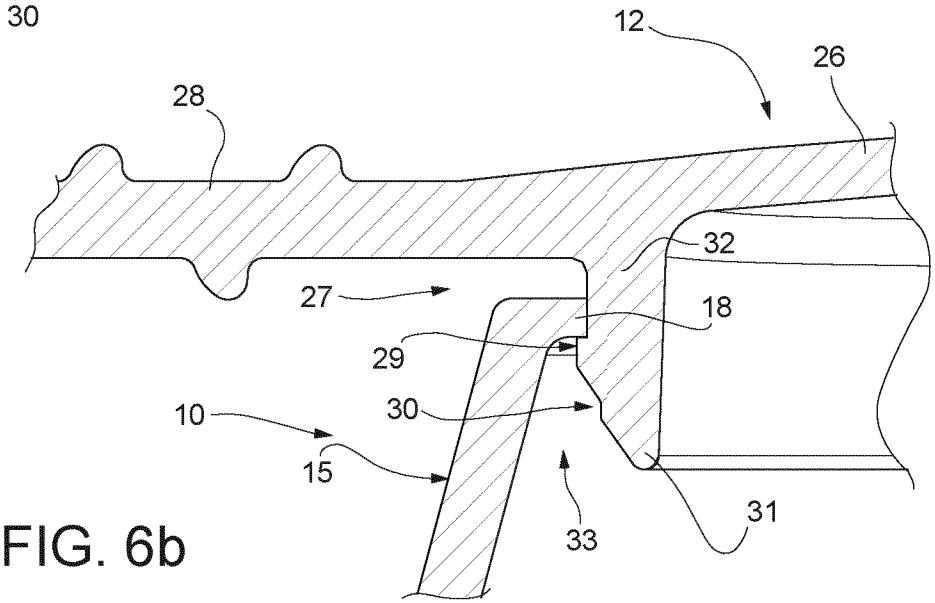
FIG. 6*b* is an enlarged section view of a detail of the lid-spout assembly being in the third configuration, with parts removed for clarity.

With particular reference to FIGS. 4 and 6*a*, lid-spout assembly 3 also comprises a coupling membrane 25, in particular an annular coupling membrane 25, rupturably connecting lid 12 and collar 15 to one another. In particular, coupling member 25 is designed to irreversibly rupture the first-time lid 12 is controlled in the open position.

In particular, coupling membrane 25 is integral to lid 12 and collar 15, in particular rim 18, prior to the first-time control of lid 12 in the open position.

Moreover, coupling membrane 25 may also be designed such to seal flow channel 17 (and as a consequence inner space 7) from an outer environment prior to the first-time control of lid 12 in the open position.

In further detail, the coupling membrane 25 is connected to lid 12 along an annular contact portion.

Advantageously, lid-spout assembly 3 is arranged in an initial configuration (see FIGS. 1, 3, 4 and 6*a*) with coupling membrane 25 being intact (i.e. coupling membrane 25 is not ruptured). Furthermore, lid-spout assembly 3 is in a used configuration (see FIGS. 2, 5, 6*b*) with coupling membrane 25 being irreversibly ruptured.

In other words, prior to a first-time control of lid 12 in the open position, lid-spout assembly 3 is in the initial configuration and after the first-time control of lid 12 in the open position, lid-spout assembly 3 is in the used configuration.

In particular, it should be noted that each lid-spout assembly 3 is immediately after the formation of the respective package 1 in the initial configuration so that the consumer receives the package 1 with lid-spout assembly 3 sealing the inner space of package 1.

Moreover, lid 12 may be controllable between the closed position and the open position with lid-spout assembly 3 being in the used configuration.

In further detail, lid 12 may be in an initial position, in particular distinct from the closed position and the open position, with lid-spout assembly 3 being in the initial configuration. In other words, lid 12 may be in the initial position with coupling membrane 25 being intact.

In particular, lid 12 is designed so that after the first-time control of lid 12 from the initial position to the open position, lid 12 is repeatedly controllable between the open position and the closed position.

In particular, lid 12 is arranged in a third angular position, in particular distinct from the first angular position and the second angular position, with respect to hinge axis B when being positioned in the initial position.

With particular reference to FIGS. 1 to 6*b*, lid 12 comprises at least a main (top) wall 26 and a side wall 27 protruding from main wall 26.

In particular, main wall 26 is configured to cover pouring outlet 11 and side wall 27 is configured to at least partially protrude into flow channel 17, in particular with lid 12 being in the closed position. Even more particular, side wall 27 is also configured to interact with collar 15, in particular rim 18 so as to laterally seal pouring outlet 15 with lid 12 being in the closed position.

Moreover, side wall 27 may have a tubular shape.

In even further detail, side wall 27 extends along a central axis C and comprises a first axial end connected to main wall 26 and a second axial end opposite to the first axial end, in particular the second axial end being a free and/or open end (i.e. side wall 27 delimits an opening at the second axial end). Alternatively, the second axial end of side wall 27 could be a free and closed end (i.e. the second axial end could comprise a wall closing also the second axial end).

Moreover, main wall 26 may have a (substantially) disc-like shape.

In more detail, side wall 27 has an annular cross-sectional shape (with respect to a cross-section plane perpendicular to central axis A).

Preferentially, an external dimension (diameter) of side wall 27 (substantially) equals an internal dimension (diameter) of collar 15, in particular relative to rim 18.

Preferentially, lid 12 also comprises a gripping element 28 configured to allow the consumer to grip gripping element 28 itself and to facilitate controlling of lid 12 between the closed position and the open position and/or from the initial position to the open position.

Advantageously, lid 12 comprises an interaction ridge 29 configured to interact with (at least a portion of) collar 15, in particular rim 18, so as to determine a closing force with lid 12 being arranged in the closed position for retaining lid 12 in the closed position. In particular, interaction ridge 29 is designed together with the portion of collar 15, in particular rim 18, to define a locking assembly for releasably locking lid 12 in the closed position.

Preferentially, interaction ridge 29 and/or side wall 27 may also be configured to laterally close and/or seal in collaboration with collar 15 and/or rim 18 pouring outlet 11.

In more detail, interaction ridge 29 is integral to side wall 27 and (radially) protrudes from side wall 27, in particular from an outer surface 30 of side wall 27.

Moreover, interaction ridge 29 may have an annular shape.

Preferentially, interaction ridge 29 is axially displaced from the contact portion, in particular such that interaction ridge 29 is interposed between main wall 26 and the contact portion. In other words, the contact portion is axially closer to the second axial end of side wall 27 than interaction ridge 29.

According to some preferred non-limiting embodiments, interaction ridge 29 is arranged such that the contact portion is axially closer to rim 18 than interaction ridge 29, in particular with lid 12 being in the initial position and/or with lid-assembly 3 being in the initial configuration and/or prior to the first-time control of lid 12 in the open position.

In particular, interaction ridge 29 is axially displaced from rim 18 with lid 12 being in the initial position and/or lid-spout assembly 3 being in the initial configuration.

Moreover, interaction ridge 29 may be arranged and designed such that once lid-spout assembly 3 is in the used configuration and lid 12 is controlled in the closed position, interaction ridge 29 is placed within flow channel 17.

Furthermore, side wall 27 may be designed such that a main portion of side wall 27 carrying interaction ridge 29 is arranged outside of flow channel 17 with lid 12 being arranged in the initial position and/or with lid-spout assembly 3 being in the initial configuration.

Moreover, side wall 27 may be designed such that a first portion 31 of side wall 27 is placed within flow channel 17 and a second portion 32 of side wall 27 is arranged outside of flow channel 17 with lid 12 being in the closed position.

Preferentially, first portion 31 comprises a part of outer surface 30 that faces an inner surface 33 of collar 15 delimiting flow channel 17.

In further detail, interaction ridge 29 may comprise an interaction surface 34, in particular facing main wall 26. The interaction surface 34 may be designed to abut against an abutment surface 35 of collar 15, in particular of rim 18. Preferentially, abutment surface 35 faces inlet opening 16 and/or rim 19.

According to some preferred non-limiting embodiments, tethering element 13 is connected to collar 15. In particular, the connection between tethering element 13 and collar 15 defines hinge axis B.

Moreover, tethering element 13 may be bendable and/or flexible and/or deflectable.

Preferentially, tethering element 13 is configured to modify its shape in dependence on the position of lid 12. Even more preferentially, tethering element 13 is controllable between at least a first configuration with lid 12 being in the closed position and a second configuration (distinct from the first configuration) with lid 12 being in the open configuration.

With particular reference to FIGS. 1 to 5, lid spout-assembly 3 further comprises a retaining group 38 configured to interact with tethering element 13 and/or lid 12 for (at least) temporarily retaining lid 12 in the open position. In particular, "temporarily retaining" means that the interaction is such that tethering element 13 and/or lid 12 can be disengaged from retaining group 38 again.

In particular, tethering element 13 is designed to be (temporarily) coupled to retaining group 38 for retaining lid 12 in the open position.

Preferentially, lid spout-assembly 3 further comprises a connection base 39 fixed to and protruding, in particular laterally protruding away, from base frame 14 and carrying retaining group 38.

Preferentially, retaining group 38 comprises a hook element 40 configured to interact with tethering element 13 for retaining lid 12 in the open position.

Preferentially, hook element 40 transversally, in particular perpendicularly, extends from connection base 39.

According to some preferred non-limiting embodiments, tethering element 13 comprises a recess 41 configured to engage retaining group 38, in particular hook element 40, so as to (at least) temporarily fix lid 12 in the open position.

In use, the outpouring of the pourable product from package 1 requires to control lid 12 in the open position so as to open pouring outlet 11. In particular, the first-time lid 12 is controlled in the open position, in particular from the initial position, lid-spout assembly 3 is controlled from the initial configuration to the used configuration and afterwards, it is possible to repeatedly control lid 12 between the closed position and the open position.

Each time lid 12 is controlled in the closed position, interaction ridge 29 interacts with collar 15, in particular rim 18, so as to lock lid 12 in the closed position by generating a closing force. This closing force must be overcome in order to move lid 12 again to the open position.

In particular, with lid 12 being in the closed position, interaction surface 34 abuts against abutment surface 35.

The advantages of lid-spout assembly 3 and/or of package 1 according to the present invention will be clear from the foregoing description.

In particular, by providing for interaction ridge 29 it is possible to lock lid 12 in the closed position, thereby reducing or even avoiding any uncontrolled movement of lid 12 from the closed position to the open position.

Another advantage resides in that interaction ridge 29 in collaboration with collar 15, in particular rim 18, defines a seal laterally sealing pouring outlet 11 when lid 12 is arranged in the closed position. Preferentially, this allows to avoid and/or limit any (substantial) lateral leakages.

Clearly, changes may be made to lid-spout assembly 3 and/or package 1 as described herein without, however, departing from the scope of protection as defined in the accompanying claims.

The invention claimed is:

1. A lid-spout assembly for a package having a main body comprising a designated pour opening and being filled with a pourable product;

the lid-spout assembly comprises at least:

a spout having a pouring outlet;

a lid configured to selectively close and open the pouring outlet; and a tethering element tethering the lid to the spout and/or the main body;

wherein the spout comprises a base frame coupling and/or configured to couple the spout to the main body about the designated pour opening; and a collar carrying and/or comprising the pouring outlet and being fixed to and protruding from the base frame, the collar extending along a central axis and comprising the pouring outlet at a first axial end of the collar and an inlet opening for the pourable product positioned at a second axial end of the collar opposite to the first axial end;

wherein the lid is moveable at least in:

a closed position in which the lid closes and/or seals the pouring outlet; and an open position in which the lid opens the pouring outlet;

wherein the lid comprises an interaction ridge being configured to interact with the collar so as to determine a closing force with the lid being arranged in the closed position for retaining the lid in the closed position;

wherein the collar further comprises a first rim delimiting the pouring outlet and a second rim opposite to the first rim and delimiting the inlet opening, the first rim radially protruding inwards and/or towards the central axis and restricting the cross-section of the pouring outlet; and wherein the interaction ridge comprises an interaction surface designed to abut against an abutment surface of the first rim, the abutment surface facing the inlet opening and/or the second rim.

2. The lid-spout assembly according to claim 1, wherein the lid comprises a side wall;

wherein the interaction ridge protrudes from the side wall.

3. The lid-spout assembly according to claim 2, wherein the collar delimits a flow channel and the side wall is at least partially arranged outside of the flow channel when the lid is positioned in the closed position.

4. The lid-spout assembly according to claim 1, wherein the interaction ridge has an annular shape.

5. The lid-spout assembly according to claim 1, further comprising a rupturable coupling membrane rupturably connecting the lid and the collar to one another.

6. The lid-spout assembly according to claim 5, wherein the lid-spout assembly is controllable from an initial configuration in which the rupturable coupling membrane is intact to a used configuration in which the rupturable coupling membrane has been irreversibly ruptured.

7. The lid-spout assembly according to claim 6, wherein the lid is in an initial position when the rupturable coupling membrane is intact.

8. The lid-spout assembly according to claim 5, wherein the coupling membrane is connected to the lid along a contact portion;

wherein the contact portion is axially displaced from the interaction ridge.

9. The lid-spout assembly according to claim 8, wherein the contact portion is axially closer to the rim than the interaction ridge prior to the first-time control of the lid in the open position.

10. The lid-spout assembly according to claim 1, wherein the collar delimits a flow channel;

wherein the interaction ridge is arranged within the flow channel with the lid being in the closed position.

11. A package comprising a main body filled with a pourable product and at least one lid-spout assembly according to claim 1 coupled to the main body.

12. The package according to claim 11, wherein the main body is formed from a multilayer composite packaging material.

13. The package according to claim 12, wherein the spout, the lid and the tethering element are directly molded from a polymer and in a single piece on the packaging material about the designated pouring outlet.

* * * * *